US008408280B1

(12) United States Patent
Kerbs et al.

(10) Patent No.: US 8,408,280 B1
(45) Date of Patent: Apr. 2, 2013

(54) BLEEDOUT DETECTION SYSTEM

(75) Inventors: Jacob Kerbs, Spokane Valley, WA (US); David A. Salee, Spokane, WA (US)

(73) Assignee: Wagstaff, Inc., Spokane, WA (US)

( * ) Notice: Subject to any disclaimer, the term of this patent is extended or adjusted under 35 U.S.C. 154(b) by 0 days.

(21) Appl. No.: 13/385,421

(22) Filed: Feb. 17, 2012

(51) Int. Cl.
*B22D 11/16* (2006.01)

(52) U.S. Cl. ..... 164/452; 164/150.1

(58) Field of Classification Search ..... 164/150.1, 164/151.5, 154.1, 155.1, 418, 452
See application file for complete search history.

(56) References Cited

U.S. PATENT DOCUMENTS 6,446,703 B1 * 9/2002 Roder et al. ..... 164/455
7,296,613 B2 * 11/2007 Anderson et al. ..... 164/452

FOREIGN PATENT DOCUMENTS

JP 07108359 A * 4/1995

* cited by examiner

*Primary Examiner* — Kevin P Kerns
*Assistant Examiner* — Kevin E Yoon
(74) *Attorney, Agent, or Firm* — Wells St. John P.S.

(57) ABSTRACT

A continuous casting mold with a bleedout detection system is disclosed, which may include a casting mold framework, a molten metal casting mold with a mold inlet and a mold outlet, the mold outlet having a mold cavity perimeter; and a bleedout detection system which may include: a signal generator that provides a balanced current to a sensor/conductor at or near the mold outlet perimeter; a current detector electrically connected to the sensor/conductor; and a programmable controller configured to receive an electrical signal from the bleedout detection system regarding the status of the sensor/conductor.

30 Claims, 15 Drawing Sheets

BLEEDOUT DETECTION SYSTEM

CROSS REFERENCE TO RELATED APPLICATION

This application does not claim priority from any other application.

TECHNICAL FIELD

This invention is relevant to the use of a sensor with inputs and/or outputs in the detection and notification to a control system of an undesired molten metal escape from a mass of solidifying metal being cast with a semi-continuous or continuous casting molten metal mold. This invention pertains to an improved bleedout detection system.

BACKGROUND OF THE INVENTION

Metal ingots, billets, and other castparts are typically formed by a casting process which utilizes a vertically oriented mold situated above a large casting pit beneath the floor level of the metal casting facility, although this invention may also be utilized in horizontal molds. The lower component of the vertical casting mold is a starting block. When the casting process begins, the starting blocks are in their upward-most position and in the molds. As molten metal is poured into the mold bore or cavity and cooled (typically by water), the starting block is slowly lowered at a predetermined rate by a hydraulic cylinder or other device. As the starting block is lowered, solidified metal or aluminum emerges from the bottom of the mold and ingots, rounds or billets of various geometries are formed, which may also be referred to herein as castparts.

While the invention pertains to the casting of metals in general, including without limitation aluminum, brass, lead, zinc, magnesium, copper, steel, etc., the examples given and the preferred embodiment disclosed may be directed to aluminum, and therefore the term aluminum or molten metal may be used throughout for consistency even though the invention applies more generally to metals.

While there are numerous ways to achieve and configure a vertical casting arrangement, FIG. 1 illustrates one example of a billet table casting arrangement. In FIG. 1 the vertical casting of aluminum generally occurs beneath the elevation level of the factory floor in a casting pit. Directly beneath the casting pit floor 101*a* is a caisson 103, in which the hydraulic cylinder barrel 102 for the hydraulic cylinder is placed.

As shown in FIG. 1, the components of the lower portion of a typical vertical aluminum casting apparatus, shown within a casting pit 101 and a caisson 103, are a hydraulic cylinder barrel 102, a ram 106, a mounting base housing 105, a platen 107 and a starting block base 108 (also referred to as a starting head or bottom block base), all shown at elevations below the casting facility floor 104.

The mounting base housing 105 is mounted to the floor 101*a* of the casting pit 101, below which is the caisson 103. The caisson 103 is defined by its side walls 103*b* and its floor 103*a*.

A typical mold table assembly 110 is also shown in FIG. 1, which can be tilted as shown by hydraulic cylinder 111 pushing mold table tilt arm 110*a* such that it pivots about point 112 and thereby raises and rotates the main casting frame assembly, as shown in FIG. 1. There are also mold table carriages which allow the mold table assemblies to be moved to and from the casting position above the casting pit.

FIG. 1 further shows the platen 107 and starting block base 108 partially descended into the casting pit 101 with castpart or billet 113 being partially formed. Castpart 113 is on the starting block base 108, all of which is known in the art and need not therefore be shown or described in greater detail. While the term starting block is used for item 114, it should be noted that the terms bottom block and starting head are also used in the industry to refer to item 114, bottom block is typically used when an ingot is being cast and starting head when a billet is being cast.

While the starting block base 108 in FIG. 1 only shows one starting block 114 and pedestal 115, there are typically several of each mounted on each starting block base, which simultaneously cast billets, special shapes or ingots as the starting block is lowered during the casting process, as shown in later Figures and as is known.

When hydraulic fluid is introduced into the hydraulic cylinder at sufficient pressure, the ram 106, and consequently the starting block 114, are raised to the desired elevation start level for the casting process, which is when the starting blocks are within the mold table assembly 110.

The lowering of the starting block base 108 is accomplished by metering the hydraulic fluid from the cylinder at a predetermined rate, thereby lowering the ram 106 and consequently the starting block at a predetermined and controlled rate. The mold is controllably cooled during the process to assist in the solidification of the emerging ingots or billets, typically using water cooling means.

There are numerous mold and casting technologies that fit into mold tables, and no one in particular is required to practice the various embodiments of this invention, since they are known by those of ordinary skill in the art.

Mold tables come in all sizes and configurations because there are numerous and differently sized and configured casting pits over which mold tables are placed. The needs and requirements for a mold table to fit a particular application therefore depends on numerous factors, some of which include the dimensions of the casting pit, the location(s) of the sources of water and the practices of the entity operating the pit.

The upper side of the typical mold table operatively connects to, or interacts with, the metal distribution system. The typical mold table also operatively connects to the molds which it houses.

When metal is cast using a semi-continuous or continuous cast vertical mold, the molten metal is cooled in the mold and continuously emerges from the lower end of the mold as the starting block base is lowered. The emerging billet 113, ingot, or other configuration is intended to be sufficiently solidified such that it maintains its desired shape. There is an air gap between the emerging solidified metal and the permeable ring wall. Below that, there is also a mold air cavity between the emerging solidified metal and the lower portion of the mold and related equipment.

Since the casting process generally utilizes fluids, including lubricants, there is necessarily conduits and/or piping designed to deliver the fluid to the desired locations around the mold cavity. Although the term lubricant will be used through this specification, it is understood that this also means fluids of all types, whether a lubricant or not, and may also include release agents.

Working in and around a casting pit and molten metal can be potentially dangerous and it is desired to continually find ways to increase safety and minimize the danger or accident potential to which operators of the equipment are exposed. In addition, it is an advantage to reduce the probability of potential damages and associated costs to the equipment and surrounding facilities.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Many of the fastening, connection, manufacturing and other means and components utilized in this invention are widely known and used in the field of the invention described, and their exact nature or type is not necessary for an understanding and use of the invention by a person skilled in the art or science; therefore, they will not be discussed in significant detail. Furthermore, the various components shown or described herein for any specific application of this invention can be varied or altered as anticipated by this invention and the practice of a specific application or embodiment of any element may already be widely known or used in the art or by persons skilled in the art or science; therefore, each will not be discussed in significant detail.

The terms "a", "an", and "the" as used in the claims herein are used in conformance with long-standing claim drafting practice and not in a limiting way. Unless specifically set forth herein, the terms "a", "an", and "the" are not limited to one of such elements, but instead mean "at least one".

It is to be understood that this invention applies to and can be utilized in connection with various types of metal pour technologies and configurations. It is further to be understood that this invention may be used on horizontal or vertical casting devices.

The mold therefore must be able to receive molten metal from a source of molten metal, whatever the particular source type is. The mold cavities in the mold must therefore be oriented in fluid or molten metal receiving position relative to the source of molten metal.

It will be appreciated by those of ordinary skill in the art that embodiments of this invention may and will be combined with new systems and/or retrofits to existing operating casting systems, all within the scope of this invention. Applicant hereby incorporates by reference, U.S. Pat. No. 6,446,704 and U.S. Pat. No. 7,296,613, as though fully set forth herein.

Figure 1:
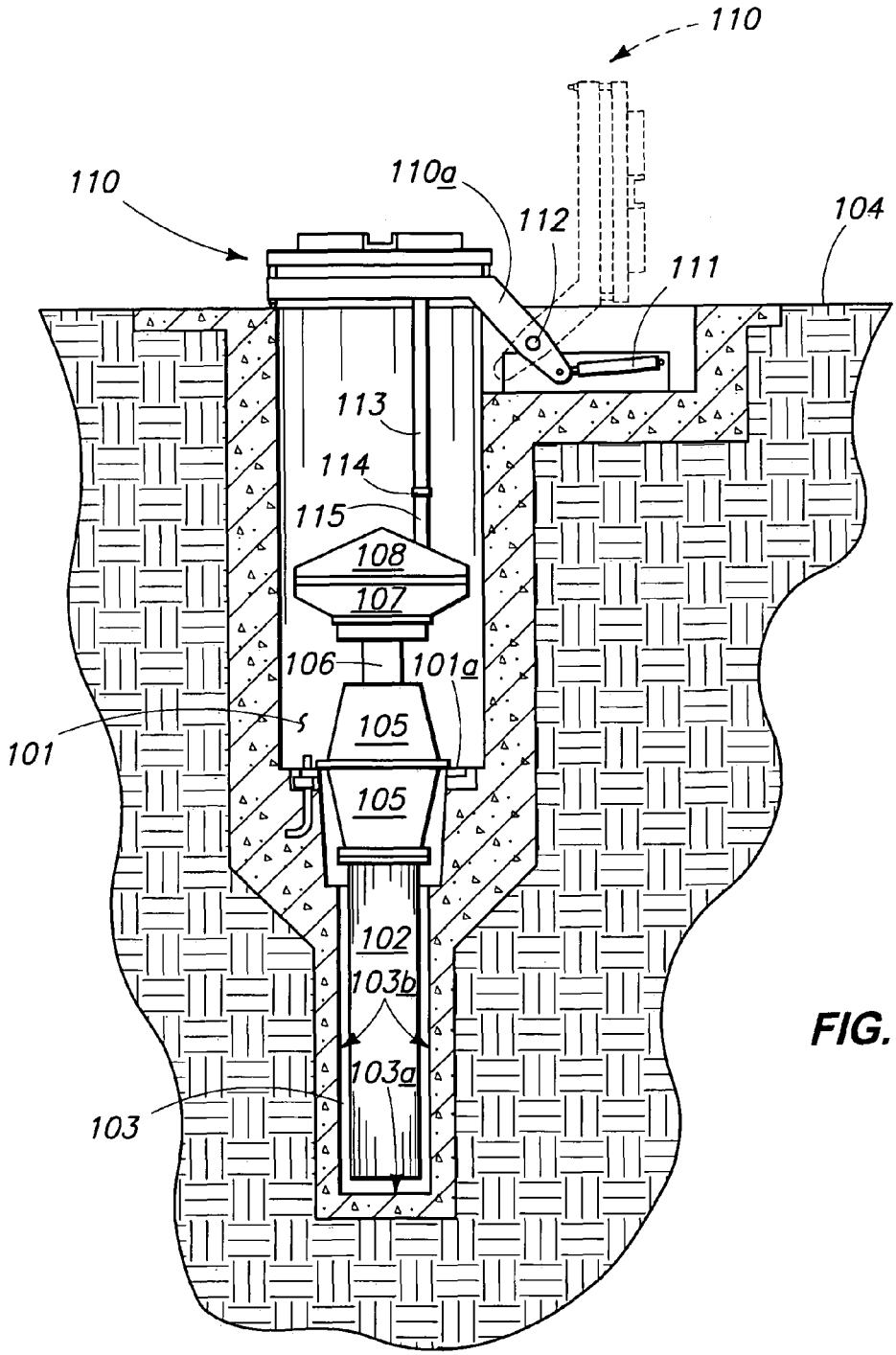
FIG. 1 is an elevation view of a typical vertical casting pit, caisson and metal casting apparatus.

FIG. 1 is an elevation view of a vertical casting pit, caisson and metal casting apparatus, and is described in more detail above.

In semi-continuous or continuous cast molding of metals such as aluminum, it is desirable to more reliably monitor for what may be referred to as a bleedout or run out condition, from the confines of either the mold cavity or through the solidifying shell of the castpart. This condition can create significant issues in the molding process (such as personnel safety and destruction of equipment), allowing molten metal to escape into the casting area.

Figure 2:
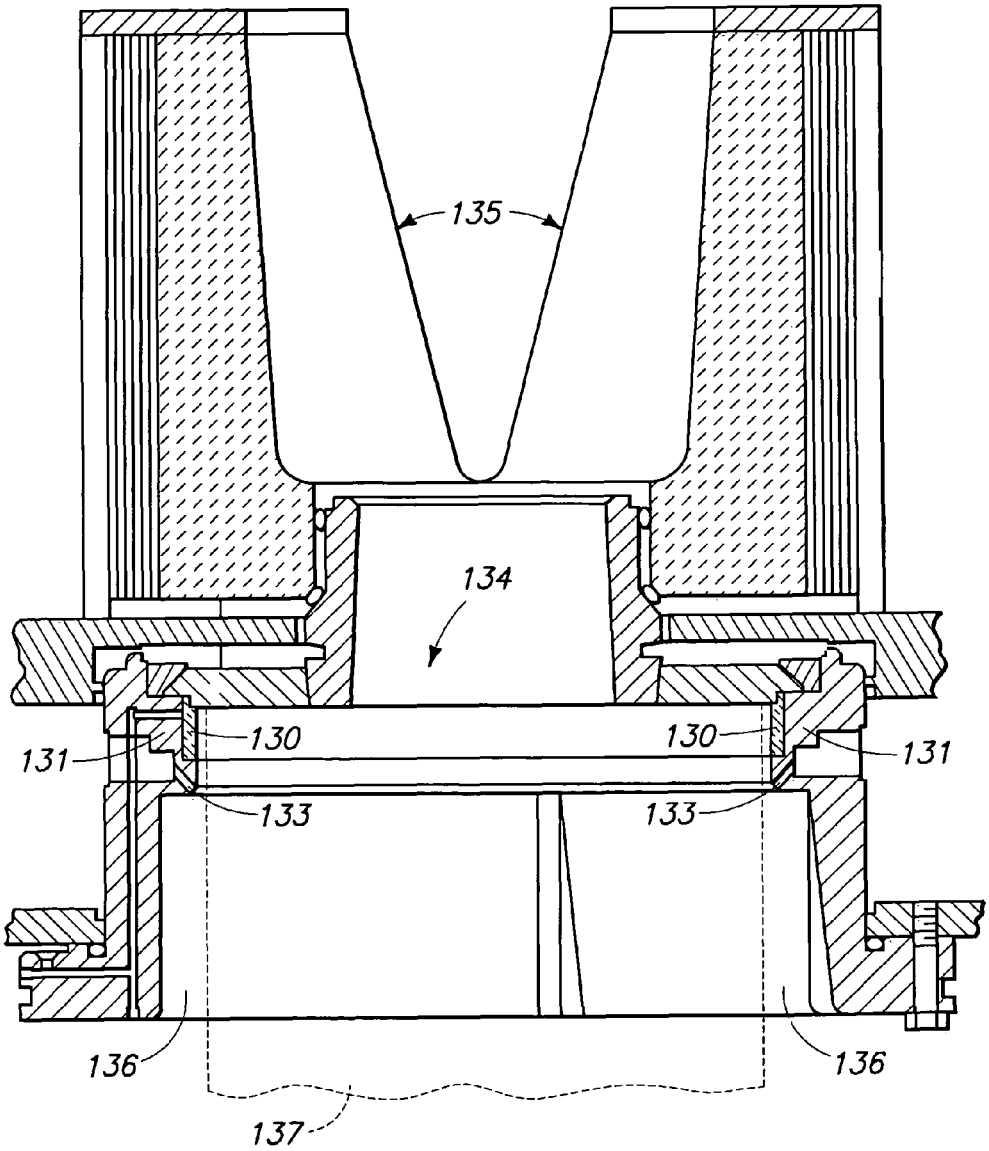
FIG. 2 is a perspective view of one of the numerous mold frameworks with which embodiments of this invention may be utilized.

FIG. 2 is a perspective view of one of the numerous mold frameworks with which embodiments of this invention may be utilized, illustrating refractory trough 135, mold inlet 134, mold outlet 136, permeable perimeter wall, 130, typically a graphite ring, water inlet conduits 133 and mold framework 131. FIG. 2 further illustrates a round castpart 137 emerging from the mold outlet 136.

Figure 2A:
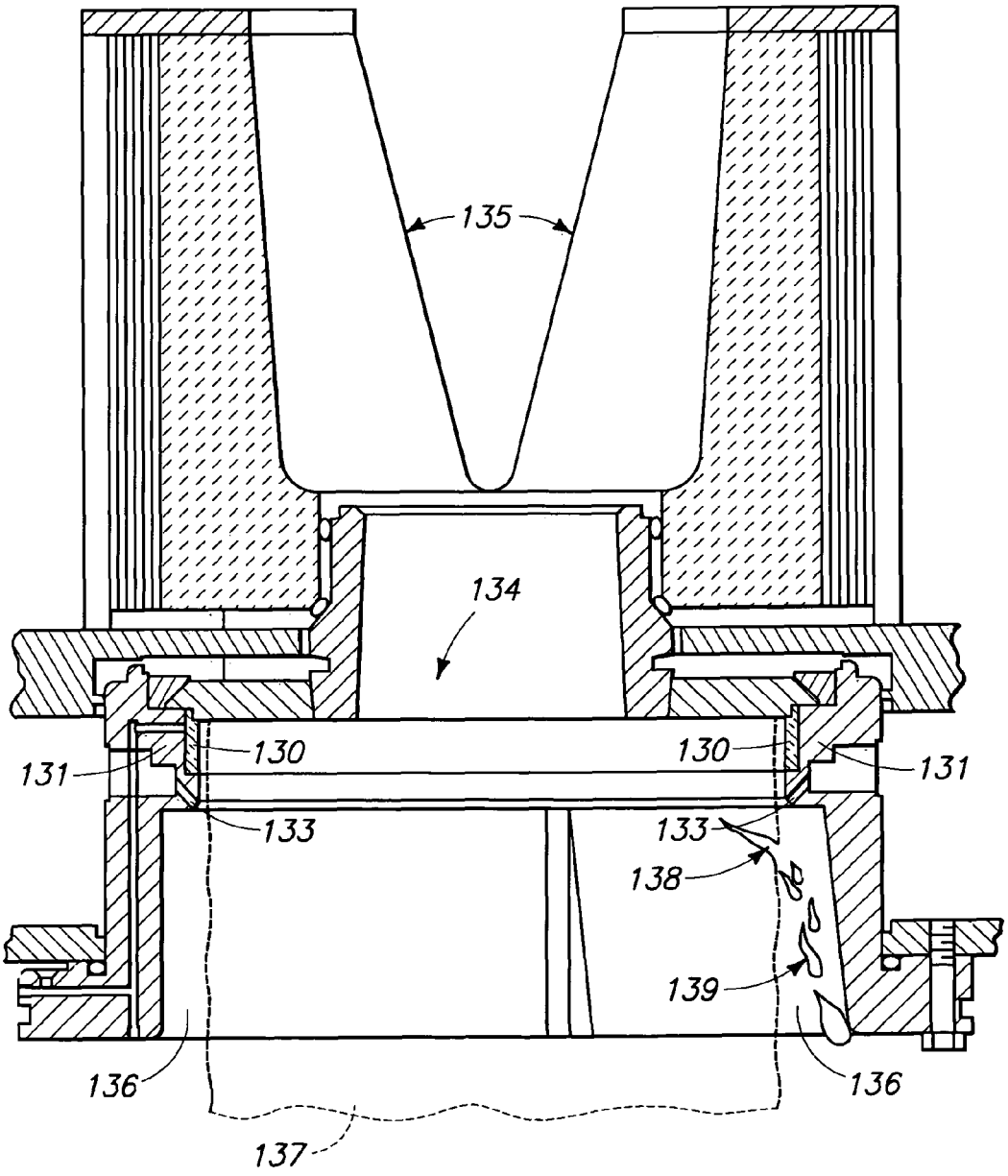
FIG. 2A is a perspective view of one of the numerous mold frameworks with which embodiments of this invention may be utilized, showing a bleedout of molten metal from the cast product.

FIG. 2A is a perspective view of the same items as described for FIG. 2, but exhibits a representative opening 138 in the outer shell of the castpart 137, resulting in molten metal 139 escaping from the normal boundaries, or in the condition represented by the term "bleedout." As would be understood by one of ordinary skill in the art, such crack appearances and bleedout conditions can vary, so that shown in FIG. 2A represents the various possible bleedout conditions.

The casting environment is harsh and caustic and tends to create significant corrosion and deterioration of exposed components. While electrically based and/or electronic components may provide more precise and controllable sensors and detectors, they are at times more susceptible to the harsh casting environment. It is therefore one object of some embodiments of this invention to provide a bleedout detection system with improved corrosion properties in the casting environment.

Figure 3:
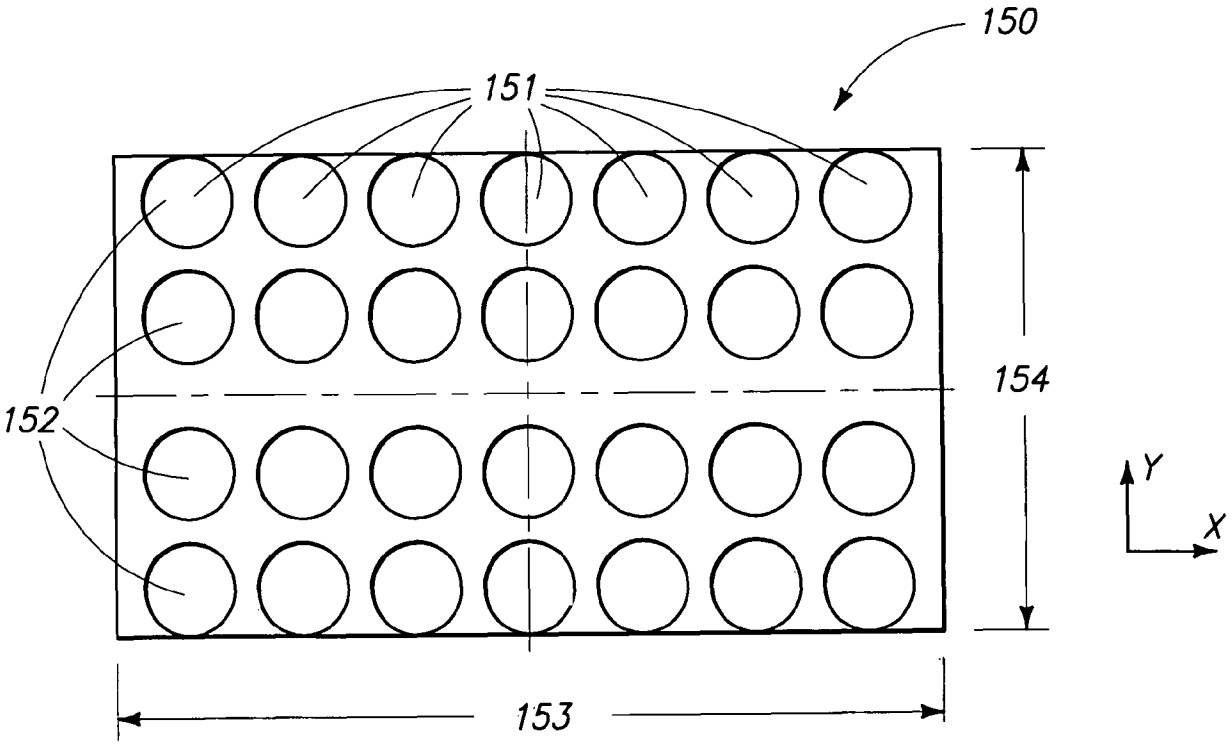
FIG. 3 is a schematic top view depiction of a mold table with four rows and seven columns of molten metal molds.

FIG. 3 is a schematic top view depiction of a mold table 150 with four rows 152 and seven columns 151 of molten metal molds, illustrating exemplary two dimensional X-Y coordinates. FIG. 3 show mold table with x dimension 153 and y dimension 154.

It has been found as part of this invention that if an oscillating or fluctuating signal such as an alternating current/voltage is used instead of a direct or constant current/voltage, and the balanced current or voltage is maintained or balanced within a range or tolerance around zero, the corrosion on the bleedout detection components is reduced, minimized and/or eliminated. It is also an object of some embodiments of this invention to provide an electrically based signal generator which provides balanced alternating current or voltage which essentially balances to a predetermined value such as zero, or within a reasonable range about zero.

Figure 4:
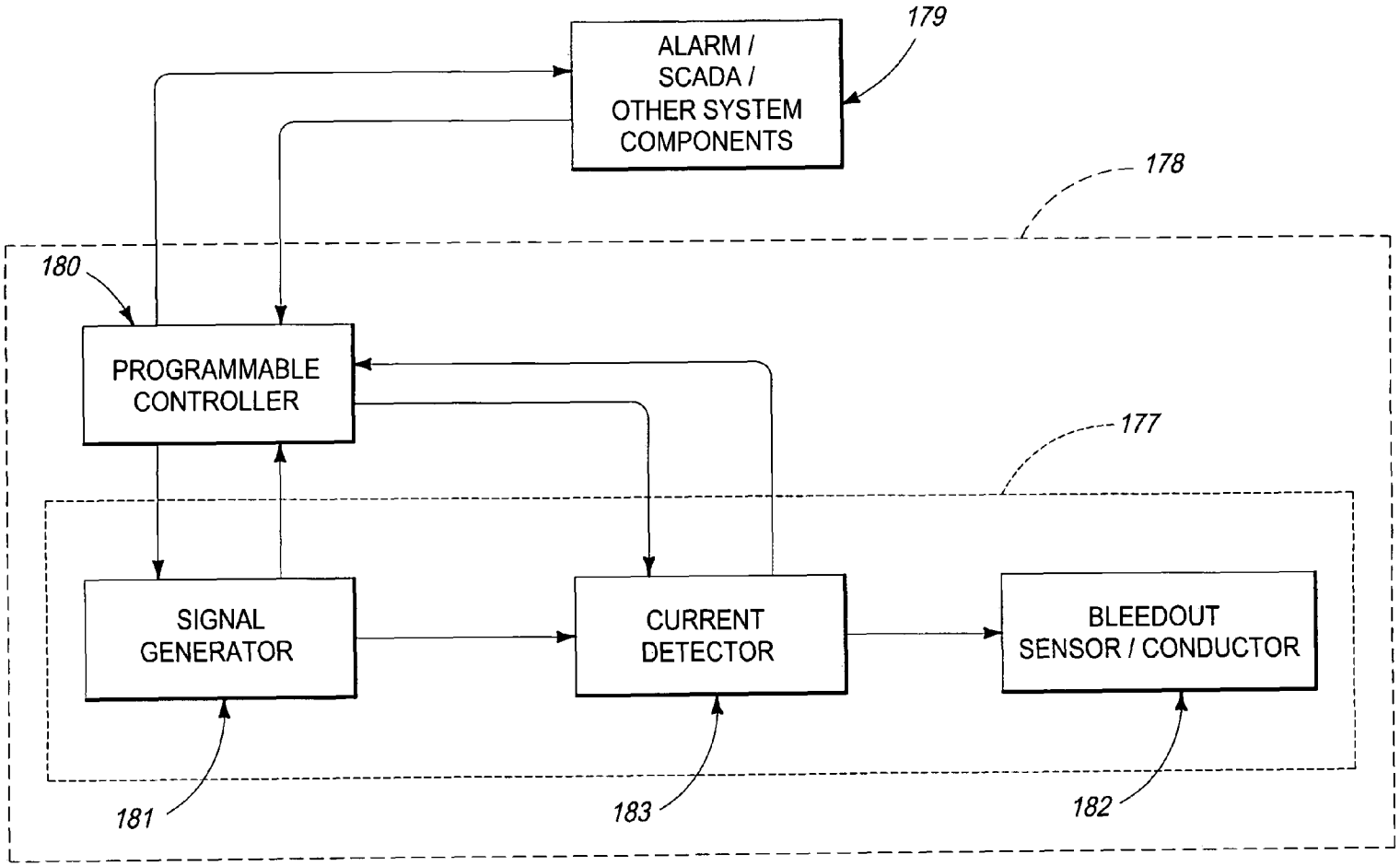
FIG. 4 Figure illustrates an exemplary schematic box diagram layout of a bleedout detection system connected to a programmable controller. The bleedout detection system consists of a signal generator and current detector and a sensor/conductor.

FIG. 4 provides a simple box diagram representing several of the main components of an embodiment of the invention, and generally illustrates embodiments of a bleedout detection system 177 and a bleedout detection control system 178. A programmable controller 180 sends output to, and receives input from, a signal generator 181. The signal generator sends the balanced current to a current detector 183 with corresponding information provided to the programmable controller 180. FIG. 4 illustrates bleedout sensor operably connected to current detector 183 and further illustrates programmable controller 180 operably connected to the alarm component 179, which may be an alarm, a SCADA system or other system component configured to receive such a signal and provide an alarm, notification, data or actions as a result.

Figure 4B:
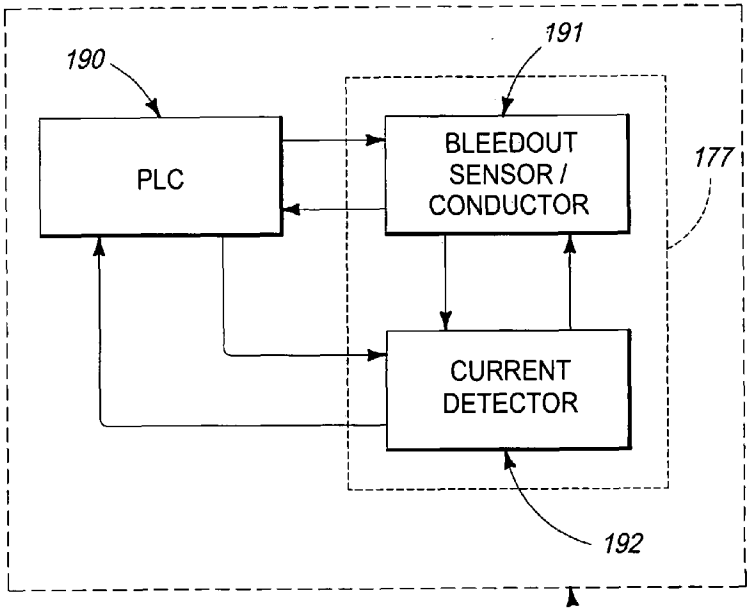
FIG. 4B illustrates how a programmable controller may be operably connected to a bleedout sensor and a current detector, wherein the programmable controller may perform the function of providing the signal generation functions.
Figure 4A:
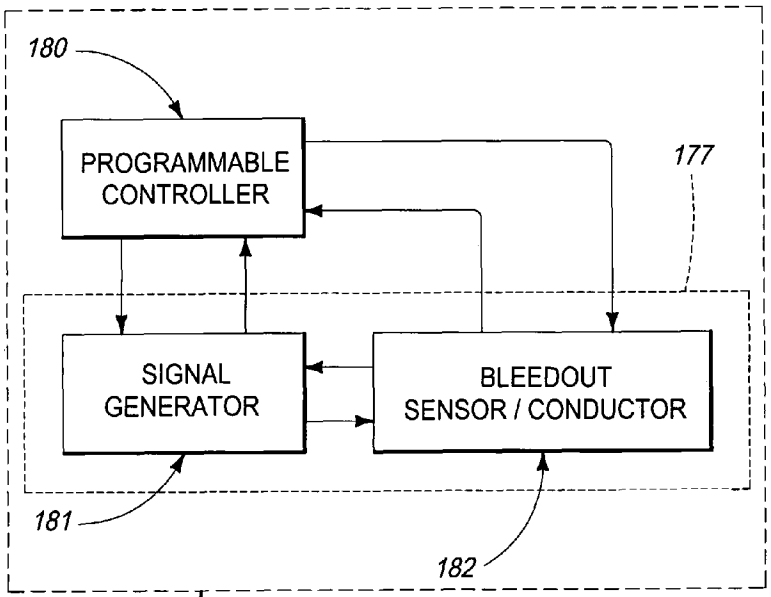
FIG. 4A illustrates how a programmable controller may be operably connected to a bleedout sensor and a signal generator, wherein the programmable controller may perform the function of providing the signal current detection functions.

FIG. 4A illustrates an exemplary configuration wherein bleedout sensor and/or conductor 182 may be connected to the programmable controller 180 components and to a signal generator 181, which is a configuration wherein the programmable controller 180 may perform the function of the current detector. FIG. 4B shows how the programmable controller 190 may be connected to a bleedout sensor 191 and a current detector 192, which is also a configuration wherein the programmable controller (which may also be referred to as a programmable logic controller or "PLC"), may perform the function of signal generation.

Figure 4C:
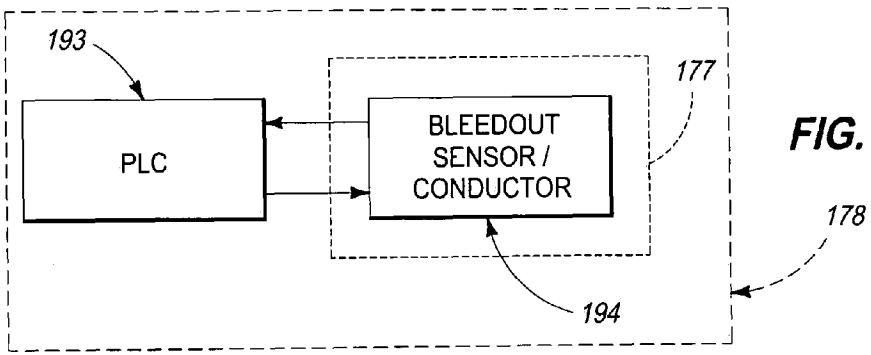
FIG. 4C an exemplary configuration of how the programmable controller or "PLC" may be operably connected to the sensor 194, wherein the programmable controller may be configured to provide both the current detection, sensing or monitoring and the signal generation functions.

FIG. 4C an exemplary configuration of how the programmable controller 193 or programmable logic controller ("PLC") is operably connected to the sensor 194 and wherein the programmable controller may be configured to provide both the current detection and the signal generation functions. As appreciated by those of ordinary skill in the art, such system arrangements could be structured in a variety of ways physically and electronically.

Figure 4E:
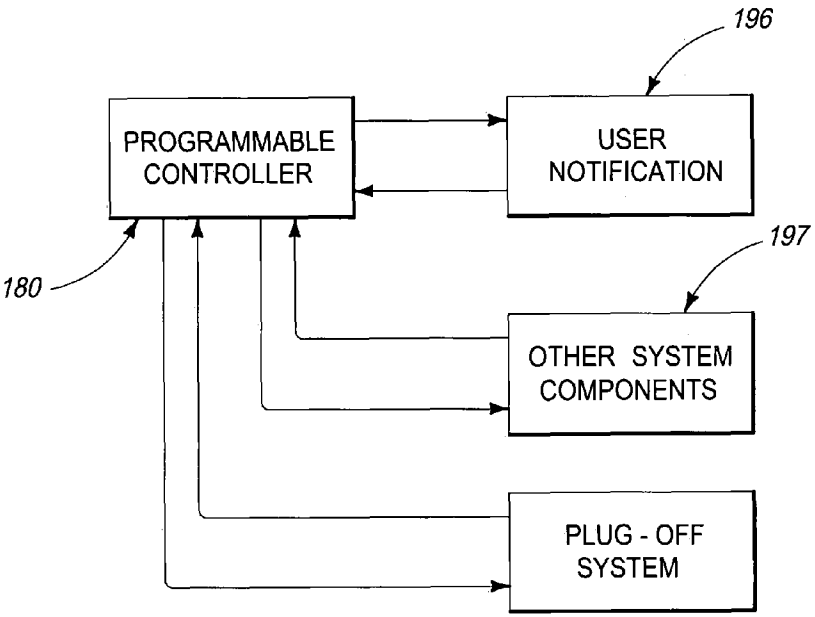
FIG. 4E illustrates an exemplary box diagram of how a programmable controller may be operably connected to a user notification system and also to other system components.
Figure 4D:
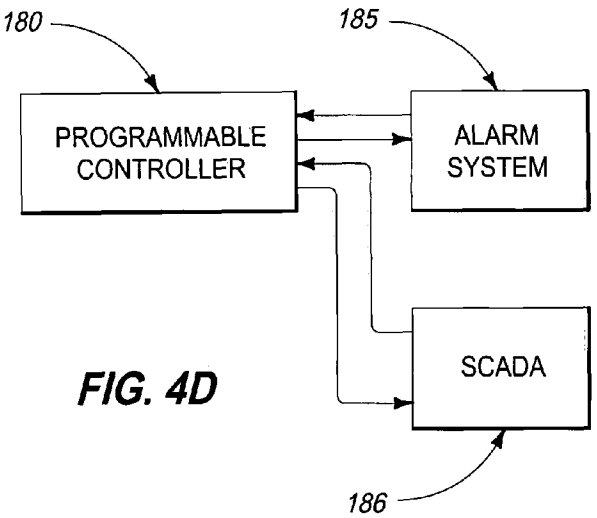
FIG. 4D illustrates an exemplary box layout or schematic of a programmable controller operably connected to an alarm system and a SCADA system.
Figure 4F:
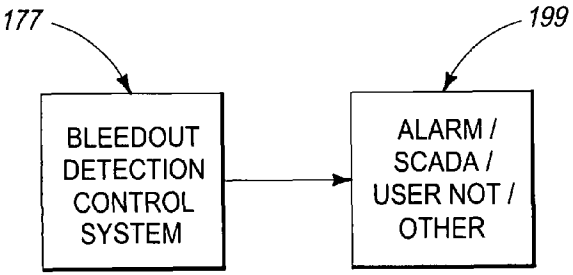
FIG. 4F illustrates through a schematic box diagram a configuration wherein a bleedout detection system is operably connected to an alarm, SCADA, a user notification or other system.

FIG. 4D illustrates an exemplary box layout or schematic of a programmable controller 180 operably connected to an alarm system 185 and a SCADA system 186. FIG. 4E illustrates an exemplary box diagram of how a programmable controller 180 may be operably connected to a user notification system 196 and also to other system components. FIG. 4F illustrates through a schematic box diagram a configuration wherein a bleedout detection system is operably connected to an alarm, SCADA, a user notification or other system 199.

Figure 5:
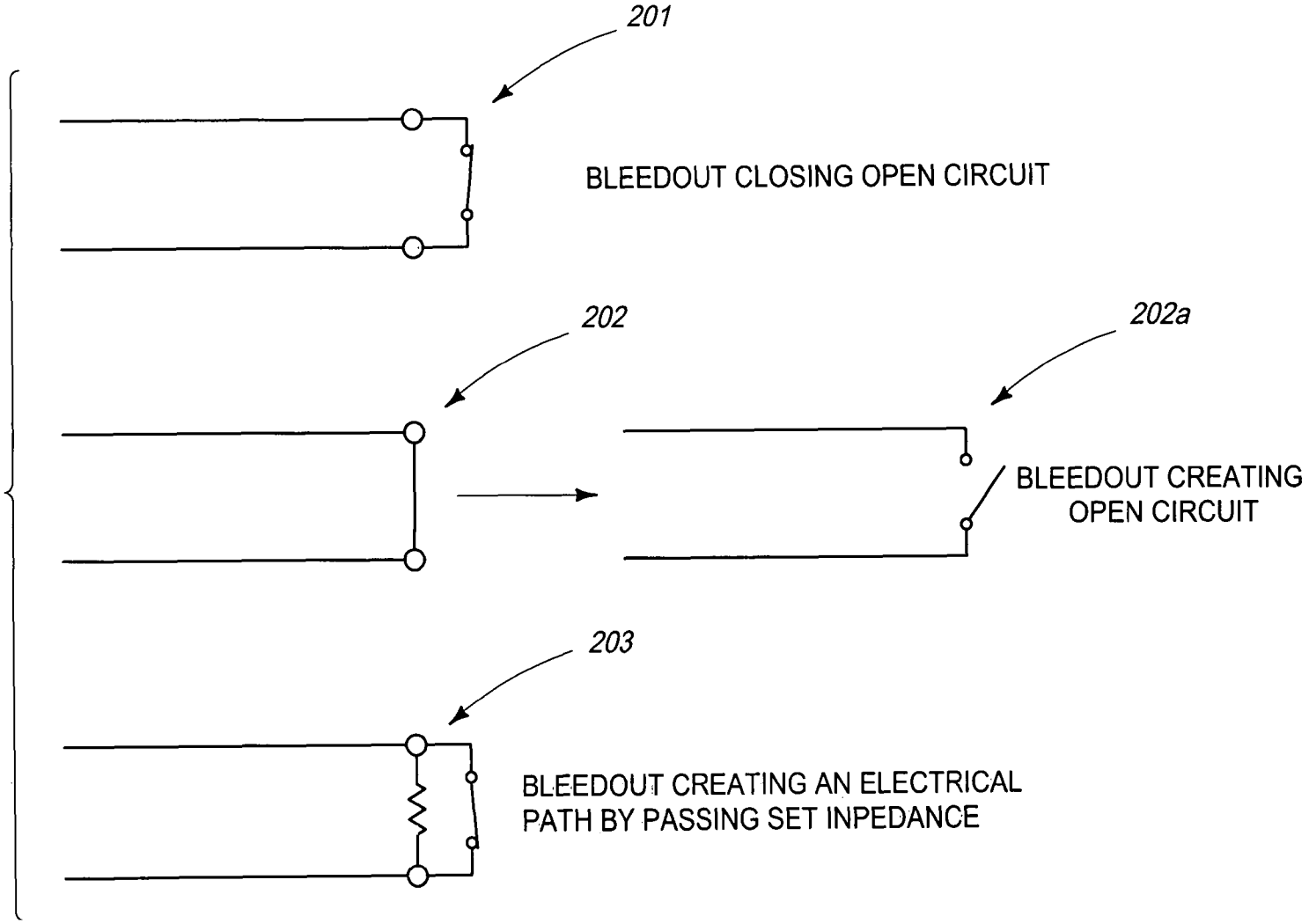
FIG. 5 illustrates the various possible impacts of bleedouts on electrical circuit paths in closing an open circuit, opening a closed circuit, or bypassing an operating level of resistance or impedance.
Figure 5A:
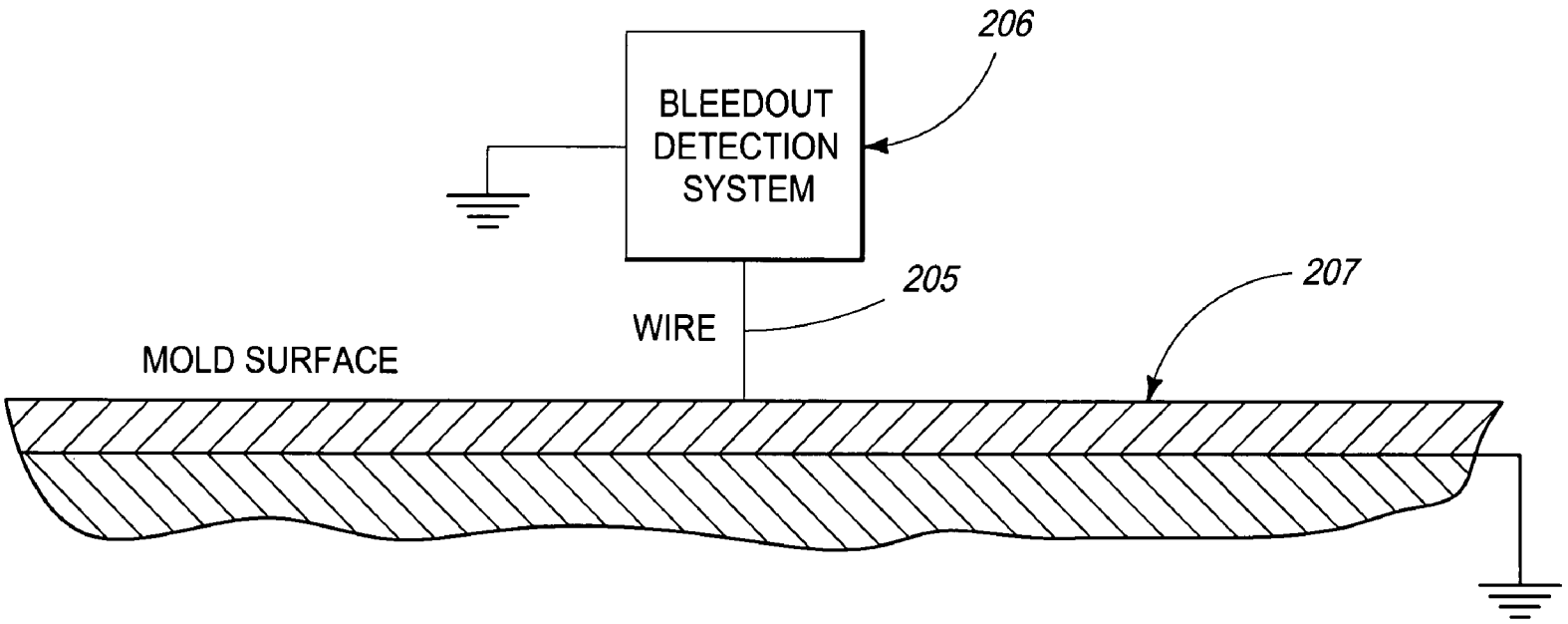
FIG. 5A provides a showing of a circuit consisting of a wire, bleedout detection system, and the mold surface.

Although bleedout detection systems in an embodiment of this invention are described wherein a bleedout sensor is configured at or near the mold outlet perimeter, it will be appreciated by those of ordinary skill in the art that the other components and elements of said system may be located either at or near the mold outlet perimeter or remote in any other location, all within the contemplation of this invention. In another embodiment of this invention, a sensor/conductor device may be located at or near the mold outlet perimeter, or could alternatively be located at the same, or a different location relative to the sensor/conductor. The sensor/conductor, as appreciated by one of ordinary skill in the art, could be arranged to form an open circuit, closed circuit, or otherwise set to operate at some expected level of normal impedance that can thus alter in a bleedout condition to show some other characteristic, such as changing from open to closed circuit, a closed to open circuit, or in changing its overall impedance in some other fashion. FIG. 5 provides sketches of a bleedout sensor/conductor that normally is in an open condition 201, is normally in a closed condition 202, or is otherwise arranged with some amount of impedance 203 as represented by the amounts of resistance. The bleedout condition can thus lead to altering the expected current levels based on normal operating conditions. FIG. 5A provides an indication of how one wire 205 may be used for an electrical connection between the bleedout detection system 206, or bleedout detector circuitry, with the use of the conducting material of the mold 207 and mold assembly to complete that path. One of ordinary skill of the art would recognize that such electrical loops could be completed using wires or various other forms of conducting material.

Figure 6:
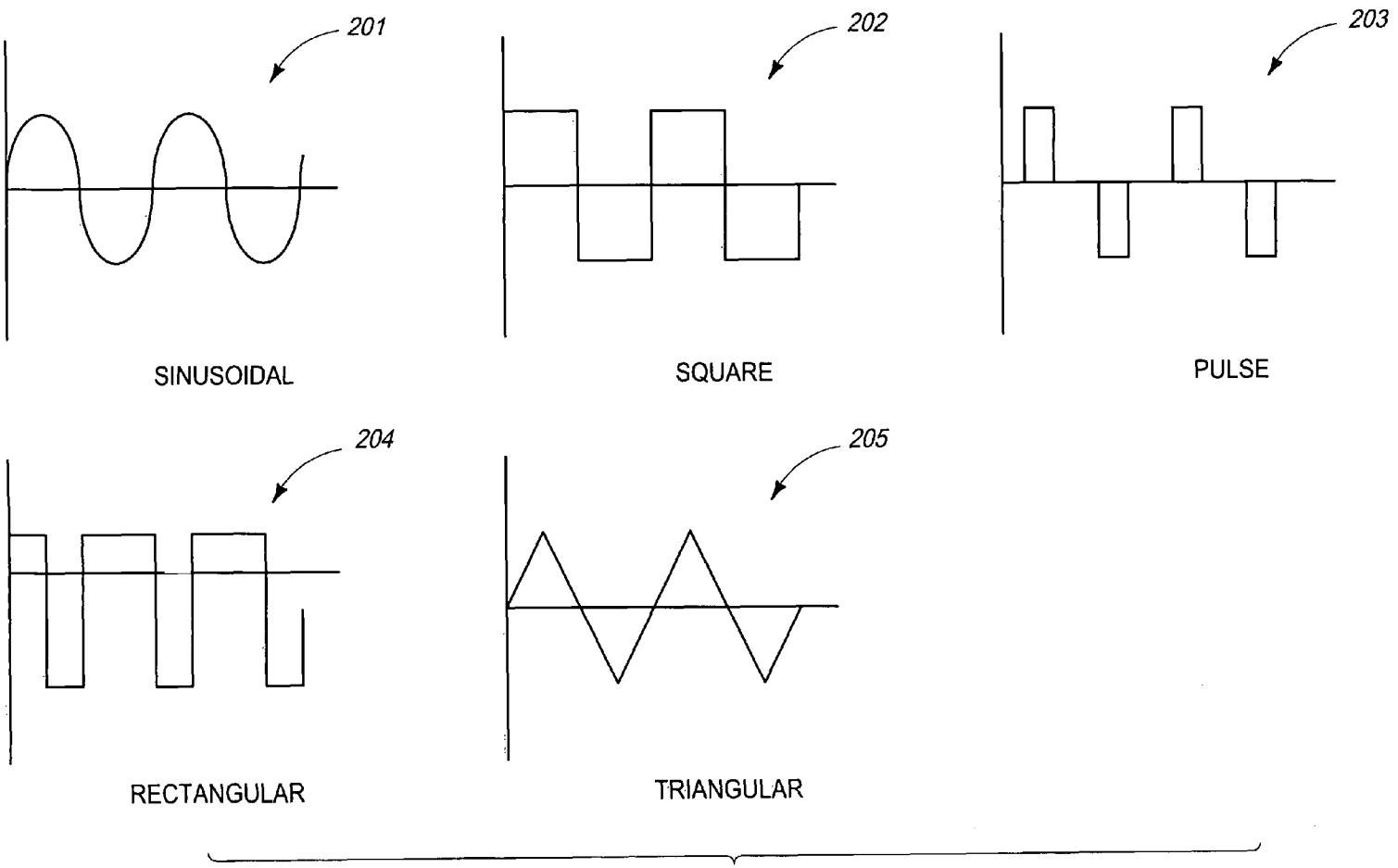
FIG. 6 is a view of several possible waveforms selected from numerous possible waveforms that could be used in the bleedout detection system.

When the term balanced current is used herein, it is intended to be broadly construed to refer to a current which is oscillating or fluctuating about an average reference line or point range. FIG. 6 provides several examples of possible waveforms, which is not exhaustive as one of ordinary skill in the art would recognize that such waveforms could be structured or varied in a high number of ways. In a typical embodiment this would be a sinusoidal current wave 201 balanced about a zero value neutral reference, but it may also refer to a square wave 202 or other shape of waveform, and that the waves or area within the square, sinusoidal, or other shaped waveform need not be identical in shape, peak value, or duration in time period in order to be balanced. Other such examples include a pulse waveform 203, rectangular waveform 204 that could be identical or of different shapes on the positive or negative sides of the average, and a triangular waveform 205. The mean or average value of the waveform, as understood by those of ordinary skill in the art, could also be referred to as, without limitation, a DC bias or DC coefficient that may or may not be at the value of zero. For one of ordinary skill in the art, the waveform could also be described as the anode or cathode values relative to time.

When the term signal generator is used herein it is used in its broadest sense to refer to any device or element that is providing, generating, or transmitting an electrical current, signal or other electrical potential or conductive energy to and/or through a bleedout sensor/conductor, which may be the bleedout sensor, or be in electrical connection with the bleedout sensor. As would be understood by one of ordinary skill in the art, the location of the bleedout signal generator can vary both physically and electronically, and could be arranged as a separate assembled electronic unit, a portion of the controller itself, or as components otherwise arranged to provide the electrical signal used by the bleedout detection system. In partial contemplation of this invention, the use of frequency from the signal generator could be employed over a wide range of values, with the possible frequencies typically being selected depending on electronic advantages such as, the desired characteristics which may result from the impedance of the sensor/conductor coolant interaction, or the resulting corrosion reduction. Similarly, the embodiments of this invention could be used with a variety of alternating waveforms provided by the signal generator as previously described.

Depending on the conductivity of the liquid used as part of the casting coolant processes, the output of the signal generator that provides the balanced current may need adjustment for optimal potential with resulting current levels. In contemplated embodiments of the invention, the output of the signal generator could be adjusted manually, set to certain values through the programmable controller, or automatically adjusted via the programmable controller. The conductivity of the liquid coolant affects the corrosion because as it runs outside over the two rings, one ring is negative and one ring is positive, and the liquid coolant has enough conductivity or the ability to allow the charge to pass there-through and thereby causing corrosion.

In an electrolytic corrosion cell ions are removed from one of the components, transferred in solution, and deposited on the other component. By using AC we effectively neutralize the electrolysis reaction thereby reducing or eliminating the resulting corrosion.

When the term bleedout sensor is used herein, it may be any one of a number of different arrangements of conducting materials, elements or components within the contemplation of this invention, such as, without limitation, a metal plate or plates, wiring, or other materials creating a conducting path with intentional normal operation levels of impedance or conductance between conducting materials. The level of impedance or conductance between the conducting materials could be set in a variety of ways known of those of ordinary skill in the art. Some embodiments within the contemplation of this invention for a bleedout sensor/conductor could include the conductivity of matter placed between the conducting metal portions, or components between the conducting materials providing resistance or reactance, or some combination forming levels of impedance, as described with FIG. 5.

Figure 7:
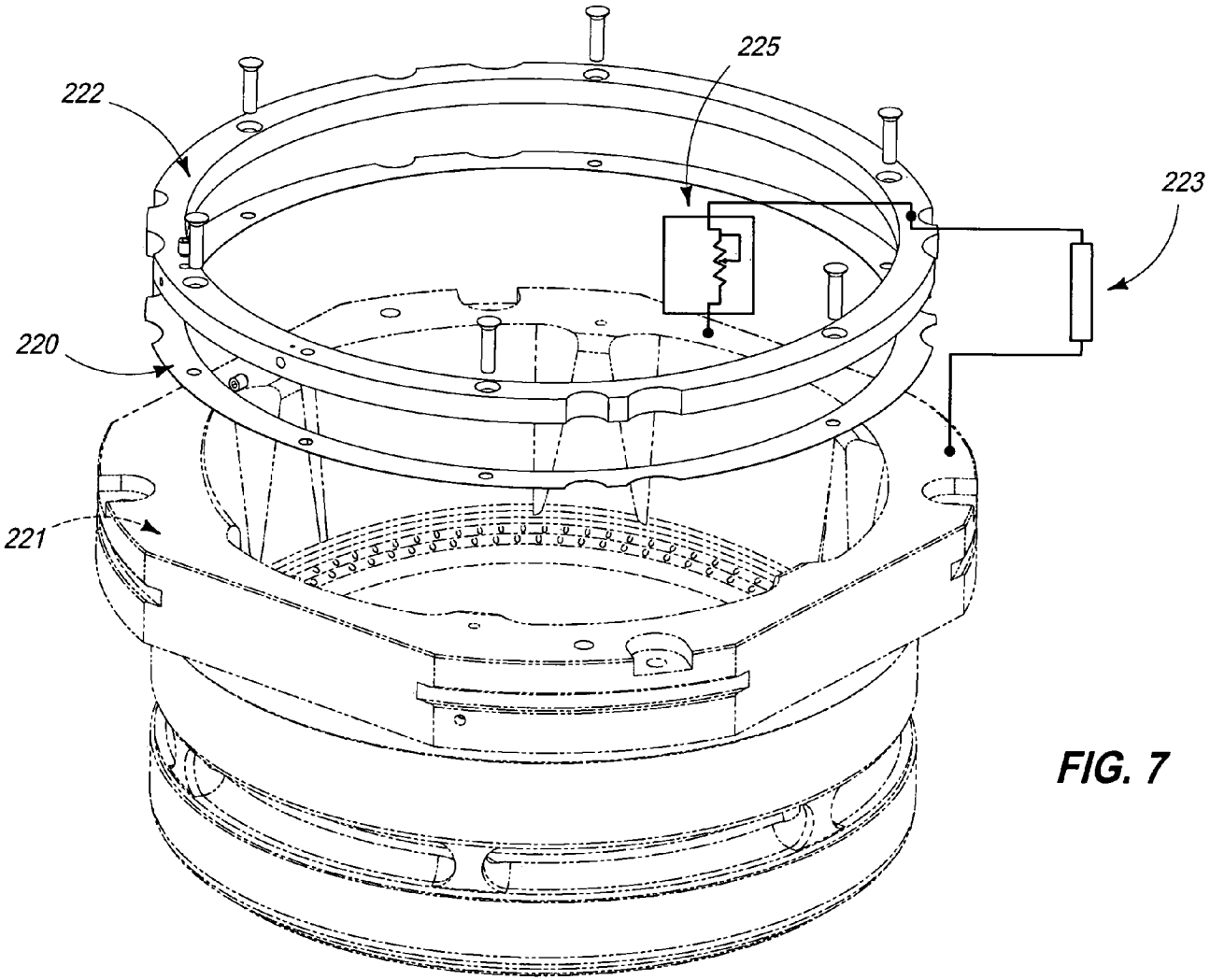
FIG. 7 is a perspective view of the exit side of a mold showing one of the many possible embodiments of a bleedout sensor consisting of one plate separated from a mold by a layer of insulation.

FIG. 7 shows one embodiment of this invention that uses an insulation layer 220 between the bottom of the mold 221 and a plate 222 (a bleedout sensor/conductor) that can be attached. In this embodiment, a resistor or other impedance component 223 is installed bypassing or passing through the insulation layer 220. The plate and mold body are electrically connected in what could be viewed as an instantaneous alternating positive and negative voltage relative to the mold body is obtained. Impedance levels that can be present due to the coolant and/or molten metal 225 are also represented in FIG. 7.

Figure 8:
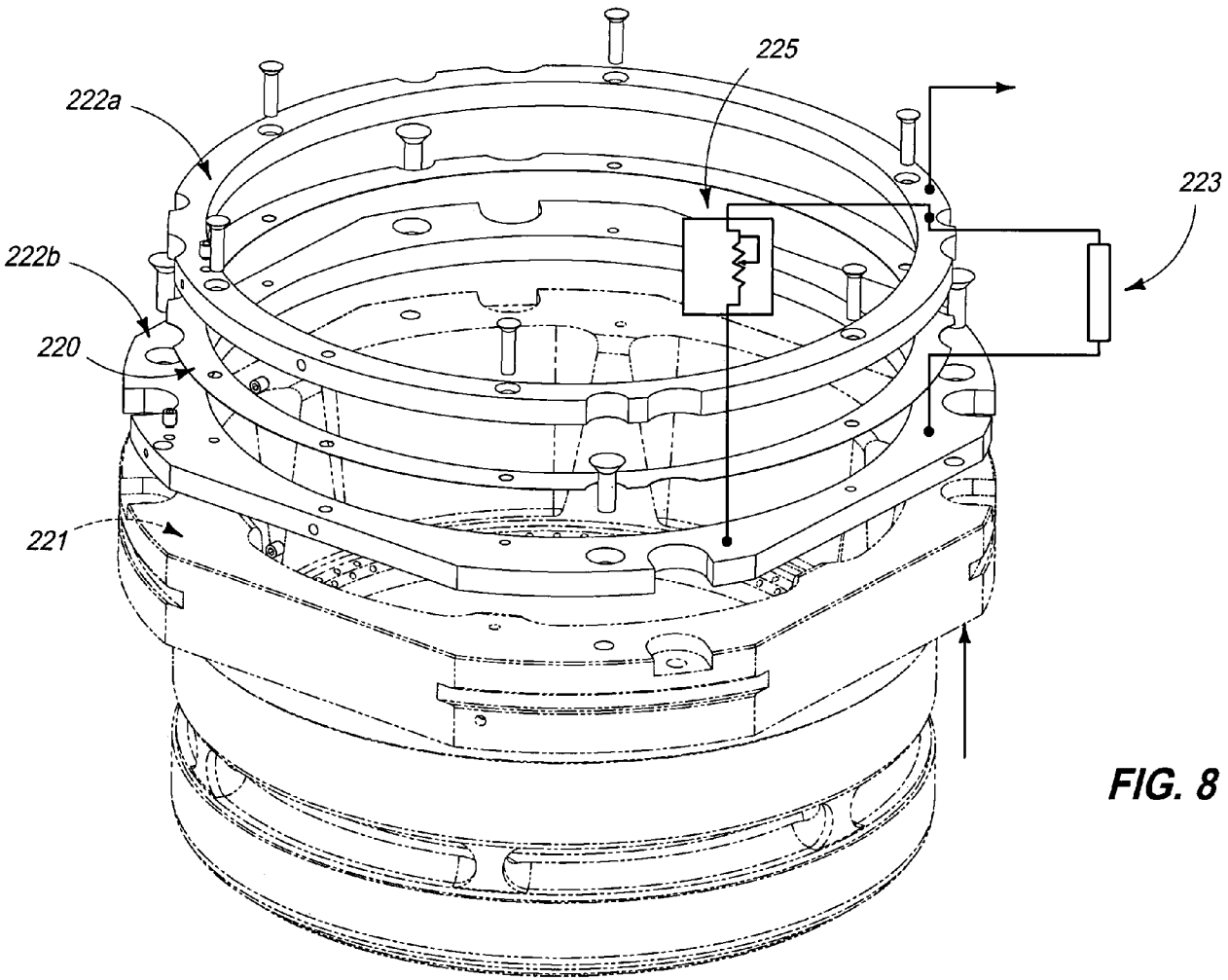
FIG. 8 is a perspective view of the exit side of a mold showing one of the many possible embodiments of a bleedout sensor consisting of two plates separated from each other by a layer of insulation.

Another embodiment uses two plates, 222*a* and 222*b*, as shown in FIG. 8 attached to the bottom of the mold 221, with an insulation layer 220 between the plates, and a resistor 223 put in place connecting the plates. The plates are electrically connected in what may be viewed as an instantaneous alternating positive and negative voltage between the two plates. Impedance levels that can be present due to the coolant and/or molten metal 225 are also represented in FIG. 8. Contemplated paths for the electrical current could include the embodiment of two or more wires to the bleedout sensor/conductor path, thus allowing its connection to the, signal generator, PLC controller and/or current detector. An additional embodiment using one wire to the bleedout sensor/conductor has also been contemplated, where the mold, and assembled mold equipment could provide one of the current paths.

Figure 9:
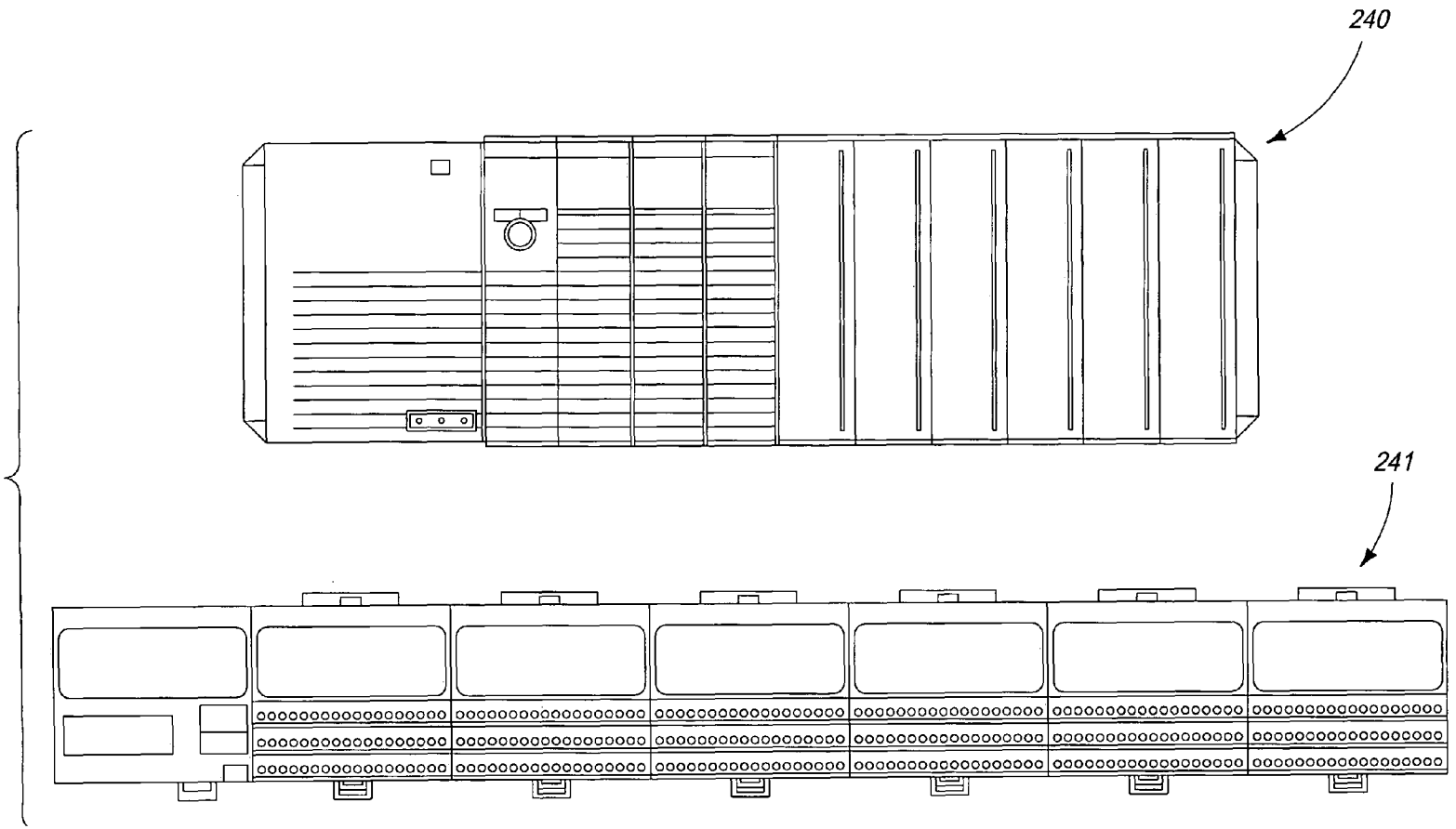
FIG. 9 is a perspective view of a main component housing representative of one which may house a programmable controller, and remote system components.
Figure 9A:
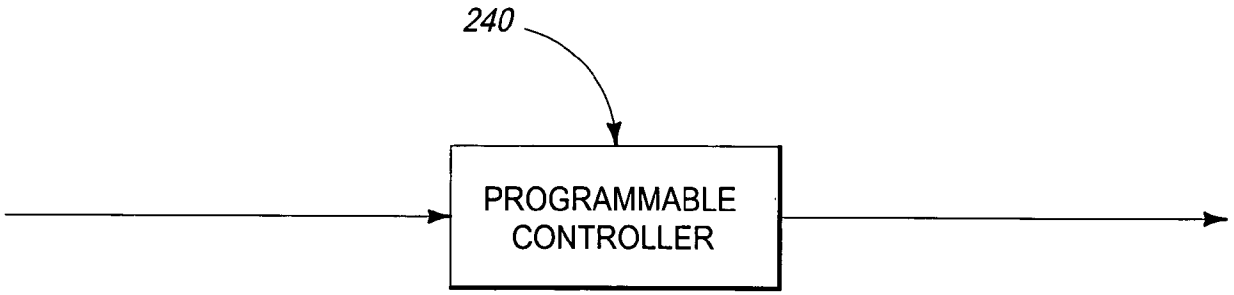
FIG. 9A shows a block diagram of a programmable controller where the system is contained in one location.
Figure 9B:
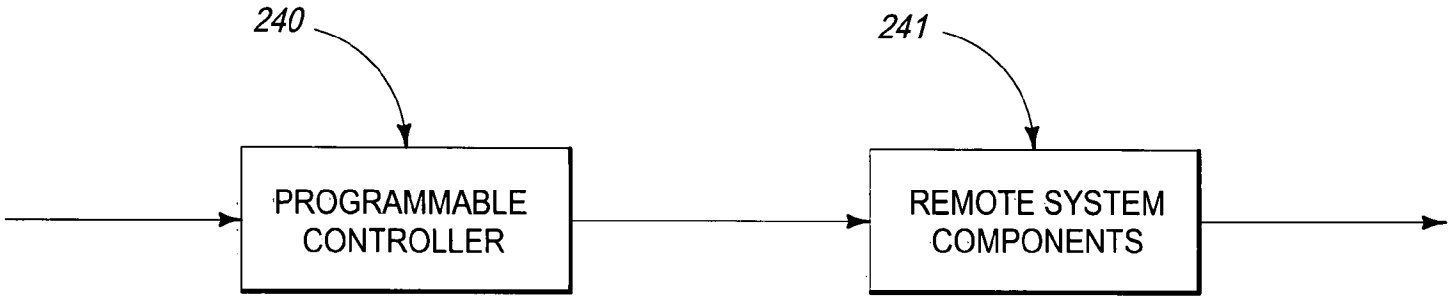
FIG. 9B shows a block diagram of a programmable controller system where the system may consist of a main central location and remote system components.

When the term controller or programmable controller is used herein, it may be referring to any number of different types of controlling structures, such as, without limitation, a programmable logic controller consisting of a main component housing 240 as shown in FIGS. 9 and 9A, or with a combination of a main component housing 240 and remote system components 241, as illustrated in FIGS. 9 and 9B. The programmable controller could refer to a controlling circuit containing adjustable components, or prewired electronics arranged to provide the desired controlling functions. One of ordinary skill in the art would appreciate that the while the use of a programmable logic controller, PLC, is common, it would not be the only alternative in the setup of a controller.

Figure 10:
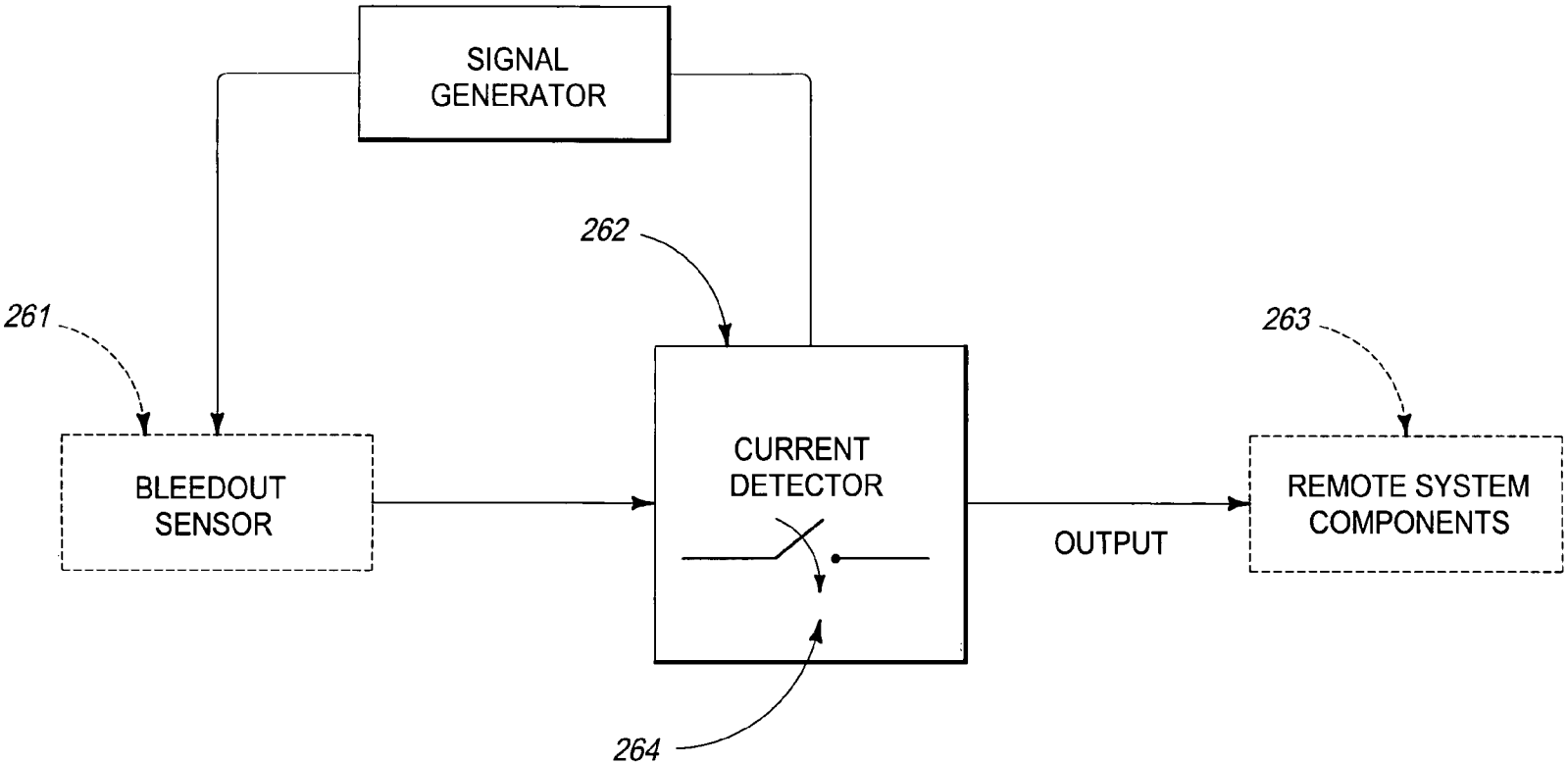
FIG. 10 shows a block diagram indicating a general relationship between a bleedout sensor, signal generator, current detector, and remote system components.

While embodiments of this invention include or utilize an electronic current detector, it should be noted that this may include: a circuit designed with a component or components that switch or otherwise change condition when facing various electrical current or potential levels, a module or component considered a part of a programmable controller, or any other material arranged to change its output in the presence of electrical potential or currents at various levels. FIG. 10 provides a sketch of an embodiment of the relationship between a bleedout sensor/conductor 261, current detector 262, and programmable controller 263. In one embodiment as shown, the current detector 262 in operation would be located to receive current or potential based on the current flow through the bleedout sensor/conductor 261, and that processes that current depending on thresholds set manually or on input from the controller, and provides output from the electronic current detector to the programmable controller based on threshold levels. A threshold latch in this embodiment is represented by an internal switch 264 that latches on when detecting a current threshold level. The current detector output to the programmable controller 263 thus changes depending on present conditions, providing information to the programmable controller regarding the state of the current detector. As considered for this invention, the term of threshold can refer to any positive or negative magnitude value that is sufficient to trigger some change in the current detector output. As known by one of ordinary skill in the art, depending on the circuit structure, such thresholds could be adjustable with the use of different components, adjustable components, or in changes in the programmable controller settings. As previously indicated and understood by those of ordinary skill in the art, the current detector could be located physically and electronically in a variety of locations. Such embodiments considered could be structured in examples of a separate assembled electronic unit, a portion of the controller itself, or components otherwise arranged to change status when faced with various levels of current.

Those of ordinary skill in the art would understand that the programmable controller could be configured for a variety of functions in connection with the other elements of the bleedout detection system in operation. Programmable controller function embodiments envisioned relative to this invention include, but are not limited to, several functions that may be used independently or individually, or in various combinations of some or all of the functions. Example inputs, not to be considered an exhaustive list of all potential and considered inputs, that the programmable controller may be setup to receive could include one or more of: a signal or signals from a current detector, the magnitude of the waveform being provided by the signal generator, and identification of the mold or molds whose bleedout sensor/conductor, is the source of the information. As appreciated by one of ordinary skill in the art, these inputs from other portions of the system may effectively be an actual electrical signal, or may be the absence of an electrical signal. Examples of contemplated outputs for the programmable controller, again not an exhaustive list, include: a command to the signal generator regarding the characteristics of the signal it provides such as magnitude, frequency, and/or waveform; and reset commands to the current detector based on the current detector status. In operation, a current detector could reach the threshold previously described. The programmable controller can be used to alter the status of the current detector set by reaching the threshold. As known by those of ordinary skill in the art, the programmable controller may be arranged respond to and/or reset the current detector, when to ignore its signal, or when use it to initiate other processes. Additional possible programmable controller outputs as contemplated as part of this invention, the programmable controller could be arranged to provide an alarm or other notification to the operator, or commands to other equipment in response to the bleedout condition. The "notification" term will be used to refer to any of these functions of an alarm, either providing of information, or in the linking to additional process steps.

Another feature envisioned in various embodiments of the invention includes a testing function, allowing the determination of the bleedout sensor/conductor current path status and operability prior to casting, during casting operations, or at any other point when desired by the user. In line with one of ordinary skill in the art, this process could be arranged in a variety of ways, but for some of the embodiments envisioned for this invention, the programmable controller directs the signal generator to modify the signal provided to the bleedout sensor/conductor, such as in the areas of magnitude, frequency, or waveform, so that the current to the current detector would meet the threshold settings of the current detector. The current detector would correspondingly send the programmable controller the information, or lack of information, which the programmable controller, in accordance with its settings, could recognize as the operability status of the bleedout sensor/conductor and its electrical connection status. As previously described in the potential programmable controller outputs, the programmable controller can then be used for one or more of the functions of redirecting the signal generator to normal operation levels, resetting of the current detector in relationship to its thresholds. In addition, the programmable controller can be arranged to recognize signals received, or not received, to be during testing processes, or outside of testing processes.

As would be understood by one of ordinary skill in the art, electrical insulation could be referring to a solid, liquid, gas, or some other form of electrical separation. As would similarly be understood, the magnitude of the wave form could vary considerably, but would ideally be kept at reasonably low levels for safety and circuit designs, but still be substantial enough to perform the desired function.

We claim:

1. A semi-continuous or continuous casting mold with a bleedout detection system comprising:

a casting mold framework;

a molten metal casting mold with a mold inlet and a mold outlet, the mold outlet having a mold cavity perimeter;

a bleedout detection system comprising:

an alternating current signal generator that provides a balanced current to a bleedout sensor/conductor;

the bleedout sensor/conductor, at or near the mold outlet perimeter;

and a current detector configured to monitor sensor/conductor impedance;

a programmable controller configured to receive an electrical signal from the bleedout detection system regarding the status of the sensor/conductor.

2. A continuous casting mold with a bleedout detection system as recited in claim 1, and further comprising an electronic current detector operatively connected between the programmable controller and the bleedout sensor/conductor, and configured to receive signals from the bleedout sensor/conductor and provide the programmable controller a bleedout status signal.

3. A continuous casting mold with a bleedout detection system as recited in claim 1, and further wherein the programmable controller receives information in the form of a lack of signal from the bleedout sensor/conductor.

4. A continuous casting mold with a bleedout detection system as recited in claim 3, and further wherein the programmable controller is configured to generate a reset signal to the electronic current detector after receiving a bleedout status signal.

5. A continuous casting mold with a bleedout detection system as recited in claim 4, and further wherein the programmable controller is configured to periodically direct the signal generator to raise the magnitude of its output signal to the bleedout sensor/conductor and detect or generate a reset signal to the electronic current detector after receiving a bleedout status signal.

6. A continuous casting mold with a bleedout detection system as recited in claim 1, and further wherein the programmable controller is configured to automatically adjust the magnitude of the signal generator output signal.

7. A continuous casting mold with a bleedout detection system as recited in claim 1, and further wherein the programmable controller is configured to automatically provide a notification or alarm to the user of the bleedout detection system.

8. A continuous casting mold with a bleedout detection system as recited in claim 1, and further wherein the programmable controller is configured to provide outputs to other system components, comprising:

a notification or alarm to a user of the bleedout detection system;

a command to other equipment to contain bleedout effects.

9. A continuous casting mold with a bleedout detection system as recited in claim 1, and further wherein the balanced current is a square wave form of alternating current.

10. A continuous casting mold with a bleedout detection system as recited in claim 1, and further wherein the alternating current waveform is in the frequency range of 1 kHz to 100 kHz.

11. A continuous casting mold with a bleedout detection system as recited in claim 1, and further wherein the alternating current waveform is in the frequency range of 20 kHz to 50 kHz.

12. A continuous casting mold with a bleedout detection system as recited in claim 1, and further wherein the programmable controller is a programmable logic controller.

13. A continuous casting mold with a bleedout detection system as recited in claim 1, and further wherein an electrical connection to each molten metal casting mold position includes one wire.

14. A bleedout detection system comprising:

an electrically conducting bleedout sensor/conductor configured at or near a mold outlet perimeter;

an alternating current signal generator that provides a balanced alternating current to the bleedout sensor/conductor;

and a programmable controller configured to receive an electrical signal from the bleedout detection system.

15. A bleedout detection system as recited in claim 14, wherein the system further comprises:

a wire to the electrically conducting bleedout sensor/conductor;

a set impedance between the electrically conducting bleedout sensor/conductor and the mold outlet perimeter; and a mold table assembly as part of a current path.

16. A bleedout detection system as recited in claim 14, wherein the system also comprises:

a wire to the electrically conducting bleedout sensor/conductor;

the electrically conducting bleedout sensor/conductor comprising;

two pieces of conducting materials separated by a set amount of impedance;

one of the pieces of conducting materials in electrical contact with a mold; and a mold and mold table assembly as part of the current path.

17. A bleedout detection system comprising:

an electrical conducting component configured at or near a mold outlet perimeter, a sensor/conductor; and a set amount of impedance between the electrical conducting material and a circuit comprising:

an alternating current signal generator; and a current detector.

18. A bleedout detection system as recited in claim 17, and further wherein the impedance comprises:

a resistor; and electrical insulation between the electrical conducting material and conducting materials at or near the mold outlet perimeter.

19. A bleedout detection/system as recited in claim 17, and further wherein the electrical conducting material comprises a plate of metal material connected at or near the mold outlet perimeter.

20. A bleedout detection/system as recited in claim 17, and further wherein the electrical conducting material comprises:

two plates of metal electrically connected to each other with a resistor; and the two plates of metal are otherwise separated by electrical insulation.

21. A bleedout detection system as recited in claim 17, wherein the alternating current signal generator is a programmable logic controller module.

22. A bleedout detection system as recited in claim 17, wherein the current detector is a programmable logic controller module.

23. A bleedout detection system as recited in claim 17, wherein the current detector is a circuit separate from a programmable controller.

24. A bleedout detection system as recited in claim 17, wherein the alternating current signal generator is a separate circuit from a programmable controller.

25. A method for detecting a bleedout condition in a semi-continuous or continuous casting molten metal mold, comprising the following:

providing an electrically conducting bleedout sensor/conductor configured at or near the mold outlet perimeter providing an alternating current signal generator that provides a balanced alternating current to the bleedout sensor/conductor;

providing a programmable controller configured to receive an electrical signal regarding the status of the bleedout sensor/conductor.

26. A method for detecting a bleedout condition in a semi-continuous or continuous molten metal mold as recited in claim 25, and further providing a current detector in connection with the programmable controller and the bleedout sensor/conductor.

27. A method for detecting a bleedout condition in a semi-continuous or continuous molten metal mold as recited in claim 25, and further wherein the current detector is set with a threshold current level.

28. A method for detecting a bleedout condition in a semi-continuous or continuous molten metal mold as recited in claim 25, and further wherein the threshold current level of the current detector triggers an output to the programmable controller.

29. A method for detecting a bleedout condition in a semi-continuous or continuous molten metal mold as recited in claim 25, and further wherein the programmable controller provides a notification.

30. A method for detecting a bleedout condition in a semi-continuous or continuous molten metal mold as recited in claim 25, and further wherein a test process is performed, comprising:

providing a programmable controller that sends a command to the signal generator to modify the magnitude of its alternating current output;

providing a current detector that electrically sends an output to the programmable controller when detecting set current levels; and providing settings of the programmable controller to recognize a signal received from the current detector as results of the test process.

* * * * *